US010037838B2

(12) United States Patent
Nawai et al.

(10) Patent No.: US 10,037,838 B2
(45) Date of Patent: Jul. 31, 2018

(54) THERMISTOR ELEMENT

(71) Applicant: Murata Manufacturing Co., Ltd., Nagaokakyo-shi, Kyoto-fu (JP)

(72) Inventors: Shinichiro Nawai, Nagaokakyo (JP); Yuichi Hirata, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/585,216

(22) Filed: May 3, 2017

(65) Prior Publication Data

US 2017/0236624 A1 Aug. 17, 2017

Related U.S. Application Data

(63) Continuation of application No. PCT/JP2015/075799, filed on Sep. 11, 2015.

(30) Foreign Application Priority Data

Nov. 7, 2014 (JP) ..... 2014-227249

(51) Int. Cl.

| | |
|---|---|
| ***H01C 7/10*** | (2006.01) |
| ***H01C 7/04*** | (2006.01) |
| ***H01C 1/14*** | (2006.01) |
| ***H01C 1/148*** | (2006.01) |

(52) U.S. Cl.

CPC ..... *H01C 7/04* (2013.01); *H01C 1/148* (2013.01); *H01C 1/1413* (2013.01)

(58) Field of Classification Search

CPC ..... H01C 7/04; H01C 1/1413; H01C 1/148
USPC ..... 338/22 R
See application file for complete search history.

(56) References Cited

U.S. PATENT DOCUMENTS

| | | | | |
|---|---|---|---|---|
| 6,008,717 | A * | 12/1999 | Kawase | H01C 1/14 338/20 |
| 6,052,272 | A | 4/2000 | Kuroda et al. | |
| 6,717,506 | B2 * | 4/2004 | Ishii | H01C 1/148 338/22 R |
| 7,696,677 | B2 * | 4/2010 | Ito | H01C 7/18 310/328 |
| 8,947,193 | B2 * | 2/2015 | Rinner | H01C 1/1413 338/22 R |
| 2002/0089409 | A1 * | 7/2002 | Ishii | H01C 1/148 338/22 R |
| 2009/0309691 | A1 * | 12/2009 | Ito | H01C 7/041 338/22 R |

(Continued)

FOREIGN PATENT DOCUMENTS

| | | |
|---|---|---|
| JP | 10-247601 A | 9/1998 |
| JP | 10-261546 A | 9/1998 |
| JP | 4985989 B2 | 7/2012 |

OTHER PUBLICATIONS

Official Communication issued in International Patent Application No. PCT/JP2015/075799, dated Dec. 1, 2015.

*Primary Examiner* — Kyung Lee
(74) *Attorney, Agent, or Firm* — Keating & Bennett, LLP

(57) ABSTRACT

A thermistor element satisfies 4≤(d/ed) when a first distance is d, which is a shortest distance between a first internal electrode and a second external electrode, whereas a second distance is referred to as ed, which is a shortest distance between the first internal electrode and a fifth internal electrode, in a cross section of a body including an L direction and a T direction thereof.

14 Claims, 7 Drawing Sheets

(56) References Cited

U.S. PATENT DOCUMENTS

2013/0207770 A1* 8/2013 Rinner ..... H01C 1/1413
338/22 R

* cited by examiner

THERMISTOR ELEMENT

CROSS REFERENCE TO RELATED APPLICATIONS

This application claims the benefit of priority to Japanese Patent Application No. 2014-227249 filed on Nov. 7, 2014 and is a Continuation Application of PCT Application No. PCT/JP2015/075799 filed on Sep. 11, 2015. The entire contents of each application are hereby incorporated herein by reference.

BACKGROUND OF THE INVENTION

1. Field of the Invention

The present invention relates to a thermistor element.

2. Description of the Related Art

Conventionally, thermistor elements include one described in Japanese Patent No. 4985989. The thermistor elements each include a body, multiple internal electrodes laminated within the body, and first and second external electrodes provided on both ends of the body.

In this regard, the shortest distance between the first external electrode and the outermost internal electrode with a polarity different from the polarity of the first external electrode, which is disposed outermost in the laminating direction, is referred to as a first distance d. The shortest distance between two internal electrodes that are adjacent in the laminating direction and different in polarity from each other is referred to as a second distance t. In this case, the distances satisfy $d/t \leq 0.96$.

As just described, the first distance d being smaller than the second distance t causes selective discharge between the first external electrode and the outermost internal electrode because the first distance d is short, when a high voltage is applied to the body. Japanese Patent No. 4985989 mentions therein that the body will thus never be broken, in the absence of discharge between the internal electrodes that differ in polarity.

Now, when the conventional thermistor element is actually manufactured and used, the thermistor element may vary in resistance from one product to another.

Considering the cause thereof, the lengths of the external electrodes vary from one product to another in a direction perpendicular to both end surfaces of the body. More specifically, the first distance d varies from one product to another. In addition, because the first distance d is short, the resistance is low between the first external electrode and the outermost internal electrode, thus increasing the contribution ratio of the resistance between the first external electrode and the outermost internal electrode to the resistance of the whole product.

Accordingly, when the first distance d varies from one product to another, the resistance between the first external electrode and the outermost internal electrode varies from one product to another, and as a result, the thermistor element resistance varies from one product to another.

SUMMARY OF THE INVENTION

Therefore, preferred embodiments of the present invention provide thermistor elements that prevent the resistance from varying one product to another.

A thermistor element according to a preferred embodiment of the present invention includes a body including a length direction, a width direction, and a height direction; two external electrodes covering both ends of the body in the length direction; and multiple internal electrodes laminated at intervals in the height direction in the body, the multiple internal electrodes include: an outermost internal electrode disposed outermost in the height direction and connected to one of the external electrodes; and an adjacent internal electrode overlapping the outermost internal electrode in the height direction and connected to the other external electrode, and in a cross section including the length direction and height direction of the body, a first distance that is a shortest distance between the outermost internal electrode and the other external electrode is denoted by d, and a second distance that is a shortest distance between the outermost internal electrode and the adjacent internal electrode is denoted by ed, the first and second distances satisfy $4 \leq (d/ed)$.

A thermistor element according to a preferred embodiment of the present invention satisfies $4 \leq (d/ed)$, thus making it possible to make the distance between the outermost internal electrode and the other external electrode equal to or more than a certain value (4ed), and thus increase the resistance between the outermost internal electrode and the other external electrode to reduce the contribution ratio of the resistance between the outermost internal electrode and the other external electrode to the resistance of the whole product. Therefore, even when the dimension of the external electrode in the length direction varies from one product to another, the resistance is prevented from varying from one product to another.

In addition, a thermistor element according to a preferred embodiment of the present invention satisfies $(d/ed) \leq 10$.

A thermistor element according to a preferred embodiment satisfies $(d/ed) \leq 10$, thus making it possible to make the distance between the outermost internal electrode and the other external electrode equal to or less than a certain value (10ed), and ensure the size of an overlap area between the outermost internal electrode and the adjacent internal electrode. Therefore, the resistance between the outermost internal electrode and the adjacent internal electrode is be kept low, and the resistance of the whole product is thus kept low.

In addition, in a thermistor element according to a preferred embodiment of the present invention, when a minimum thickness of the body is denoted by Tm between a surface of the body and an internal electrode located closest to the surface, among the multiple internal electrodes, in the height direction, and when a minimum thickness of the body is denoted by Wm between a surface of the body and an internal electrode located closest to the surface, among the multiple internal electrodes, in the width direction, the minimum thicknesses satisfy $(Tm/Wm) \leq 0.4$.

Because the thermistor element according to the preferred embodiment mentioned above satisfies $(Tm/Wm) \leq 0.4$, the thickness of the body between the surface of the body and the outermost internal electrode is be reduced in the height direction to make the outermost internal electrode close to the other external electrode. According to a preferred embodiment of the present invention, the distance between the outermost internal electrode and the other external electrode is able to be equal to or more than a certain value, because $4 \leq (d/ed)$ is satisfied. For example, in the small-size and low-profile thermistor element, there is a need to increase the number of internal electrodes to lower the resistance, thus reducing the distance between the body surface and the outermost internal electrode, and $(Tm/Wm) \leq 0.4$ may be thus satisfied. Even in this case, the resistance is able to be prevented from varying from one product to another.

In addition, in a thermistor element according to a preferred embodiment of the present invention, a number of the internal electrodes connected to one of the external electrodes and a number of the internal electrodes connected to the other external electrode are odd numbers.

In accordance with the thermistor element according to the preferred embodiment mentioned above, the number of the internal electrodes connected to one of the external electrodes and the number of the internal electrodes connected to the other external electrode are odd numbers, thus making the internal electrode connected to one of the external electrodes likely to be structurally biased to the other external electrode due to manufacturing reasons. More specifically, the outermost internal electrode is likely to be structurally close to the other external electrode. According to a preferred embodiment of the present invention, because $4 \leq (d/ed)$ is satisfied, the distance between the outermost internal electrode and the other external electrode is able to be made equal to or more than a certain value, and the resistance is thus prevented from varying from one product to another.

In addition, in a thermistor element according to a preferred embodiment of the present invention, a number of the internal electrodes connected to one of the external electrodes and a number of the internal electrodes connected to the other external electrode are even numbers.

In accordance with the thermistor element according to the preferred embodiment mentioned above, the number of the internal electrodes connected to one of the external electrodes and the number of the internal electrodes connected to the other external electrode are even numbers, thus making the internal electrode connected to one of the external electrodes unlikely to be structurally biased to the other external electrode due to manufacturing reasons. More specifically, the outermost internal electrode is unlikely to be structurally close to the other external electrode. Therefore, the distance between the outermost internal electrode and the other external electrode is easily made equal to or more than a certain value, thus making it possible to prevent the resistance from varying from one product from another.

Thermistor elements according to preferred embodiments of the present invention satisfy $4 \leq (d/ed)$, thus making it possible to prevent the resistance from varying from one product to another.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
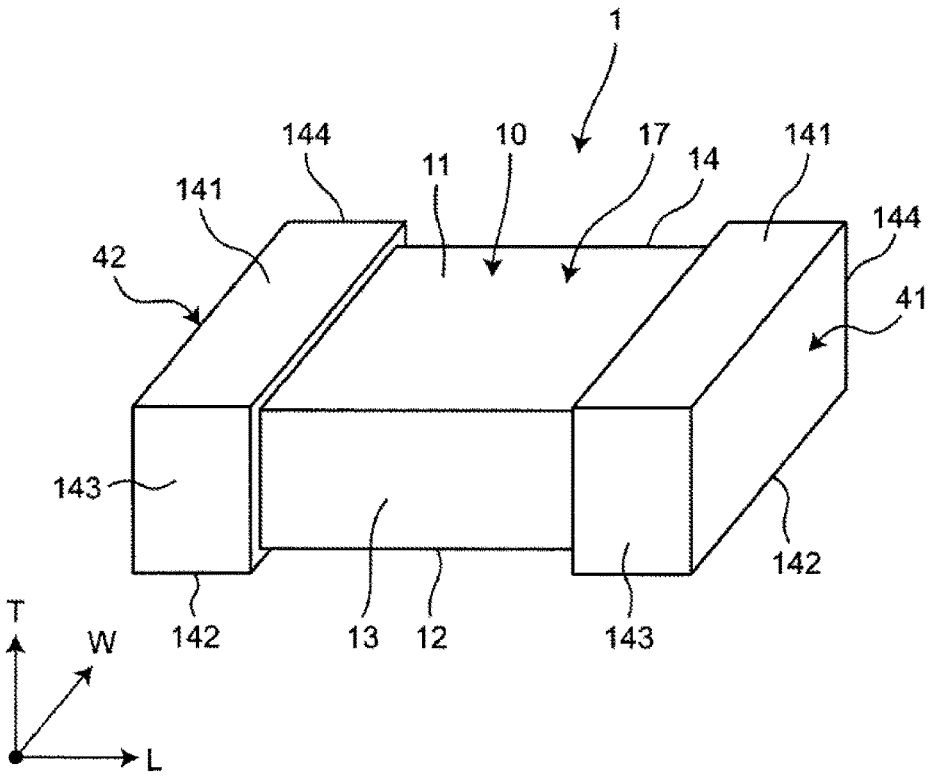
FIG. 1 is a perspective view illustrating a thermistor element according to a first preferred embodiment of the present invention.

The present invention will be described in more detail below with reference to preferred embodiments illustrated in the drawings.

First Preferred Embodiment

Figure 2:
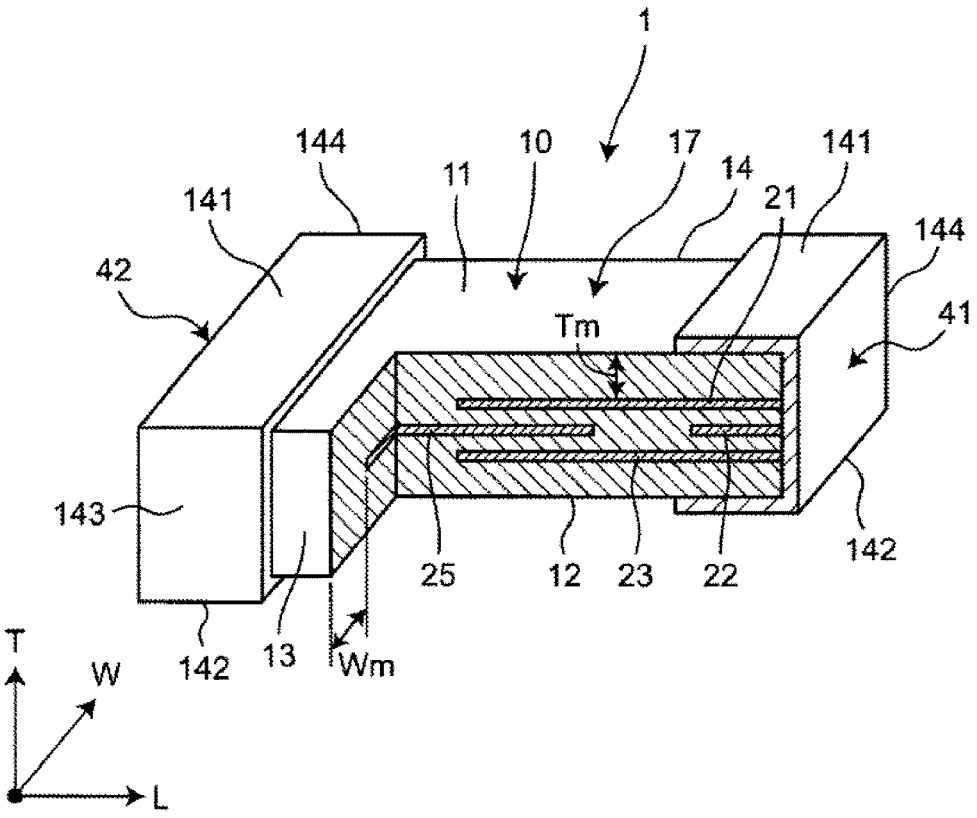
FIG. 2 is a perspective view illustrating a partially fractured thermistor element.
Figure 3:
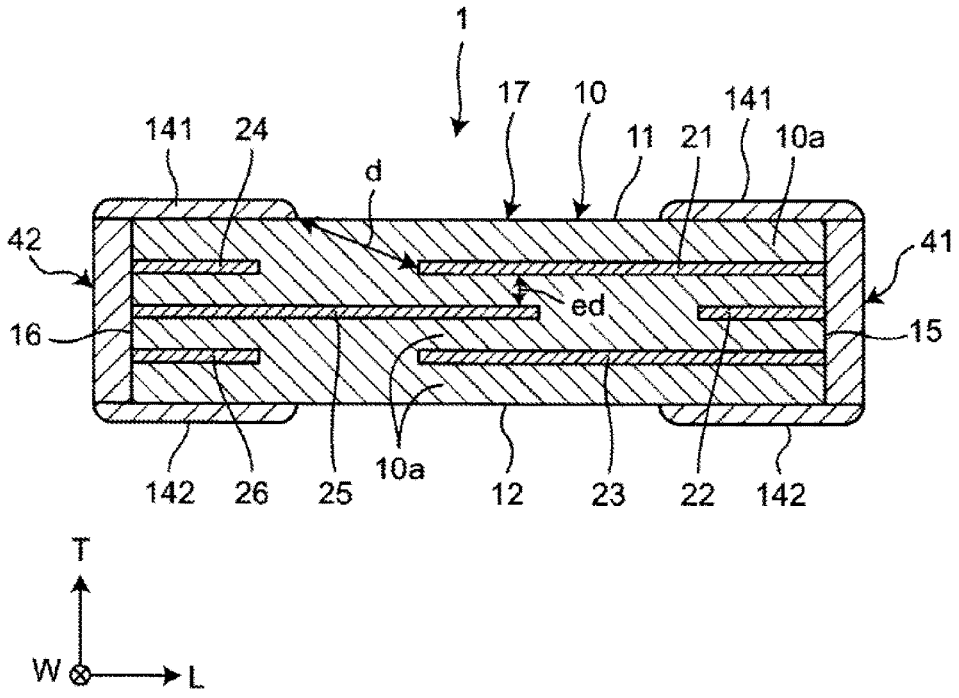
FIG. 3 is a cross-sectional view of the thermistor element at an LT surface thereof.

FIG. 1 is a perspective view illustrating a thermistor element according to a first preferred embodiment of the present invention. FIG. 2 is a perspective view illustrating a partially fractured thermistor element. FIG. 3 is a cross-sectional view of the thermistor element at an LT surface thereof. As shown in FIGS. 1, 2, and 3, the thermistor element 1 includes a body 10, multiple internal electrodes 21 to 26 provided within the body 10, first and second external electrodes 41, 42 partially covering the surface of the body 10, and electrically connected to the multiple internal electrodes 21 to 26.

The body 10 includes a length direction (L direction), a width direction (W direction), and a height direction (T direction). Concretely speaking, the body 10 preferably has cuboid or substantially cuboid shape.

The surface of the body 10 includes a first end surface 15 and a second end surface 16 located opposite to each other, and a peripheral surface 17 disposed between the first end surface 15 and the second end surface 16. The first end surface 15 and the second end surface 16 are parallel or substantially parallel to each other. The peripheral surface 17 includes a first side surface 11, a second side surface 12, a third side surface 13, and a fourth side surface 14. The first side surface 11 and the second side surface 12 are located in a direction in which ceramic layers 10*a* are laminated, and located opposite to each other. The third side surface 13 and the fourth side surface 14 are located opposite to each other. The first side surface 11 and the second side surface 12 are parallel or substantially parallel to each other. The third side surface 13 and the fourth side surface 14 are parallel or substantially parallel to each other. The first end surface 15, the first side surface 11, and the third side surface 13 are perpendicular or substantially perpendicular to each other.

The L direction refers to a direction of extending from the second end surface 16 toward the first end surface 15. The W direction refers to a direction of extending from the third side surface 13 toward the fourth side surface 14. The T direction refers to a direction of extending from the second side surface 12 toward the first side surface 11. Concretely speaking, the L direction refers to a direction perpendicular or substantially perpendicular to the first end surface 15, the W direction refers to a direction perpendicular or substantially perpendicular to the third side surface 13, and the T direction refers to a direction perpendicular or substantially perpendicular to the first side surface 11. The L direction, the W direction, and the T direction are perpendicular or substantially perpendicular to each other.

The body 10 includes the multiple ceramic layers 10*a* laminated together to define an integral structure. The ceramic layers 10*a* are composed of, for example, a ceramic that has negative resistance-temperature characteristics. The ceramic is, for example, a ceramic containing a manganese oxide as its main constituent, which includes a nickel oxide, a cobalt oxide, alumina, an iron oxide, a titanium oxide, a zirconium oxide, and the like. More specifically, the thermistor element 1 preferably is an NTC (Negative Temperature Coefficient) thermistor, which decreases in resistance value with an increase in temperature.

The first and second external electrodes 41, 42 each include an electrode layer covering the body 10, and a plated layer laminated on the electrode layer. The electrode layer is composed of, for example, Ag. The plated layer may be a single layer, or multiple layers. The single plated layer and the outermost layer of the multiple plated layers are composed of, for example, Sn or Cu.

The first external electrode 41 covers the first end surface 15, and the peripheral surface 17 closer to the first end surface 15. The first external electrode 41 is opposed to the entire periphery of the peripheral surface 17 in the peripheral direction. More specifically, the first external electrode 41 includes first to fourth surface sections 141 to 144 sequentially opposed to the first to fourth side surfaces 11 to 14. The first to fourth surface sections 141 to 144 refer to sections that extend along the peripheral surface 17. More specifically, the first to fourth surface sections 141 to 144 extend from one end surface of the first external electrode 41 in the L direction to the other end surface thereof. It is to be noted that while the zones of the first surface section 141 to the fourth surface section 144 are illustrated in FIG. 3 for the sake of making clear distinctions between the first surface section 141 to the fourth surface section 144, the first external electrode 41 is actually an integrated structure.

The second external electrode 42 covers the second end surface 16, and the peripheral surface 17 closer to the second end surface 16. The second external electrode 42 is opposed to the entire periphery of the peripheral surface 17 in the peripheral direction. More specifically, the second external electrode 42 includes first to fourth surface sections 141 to 144 sequentially opposed to the first to fourth side surfaces 11 to 14. The first to fourth surface sections 141 to 144 refer to sections that extend along the peripheral surface 17. More specifically, the first to fourth surface sections 141 to 144 extend from one end surface of the second external electrode 42 in the L direction to the other end surface thereof. It is to be noted that while the zones of the first surface section 141 to the fourth surface section 144 are illustrated in FIG. 3 for the sake of making clear distinctions between the first surface section 141 to the fourth surface section 144, the second external electrode 42 is actually an integrated structure.

The multiple internal electrodes 21 to 26 are laminated within the body 10 at intervals in the T direction. The internal electrodes 21 to 26 and the ceramic layers 10*a* are laminated alternately in the T direction. The internal electrodes 21 to 26 contain, for example, at least one element of Ag, Pd, and Cu.

The first, second, and third internal electrodes 21, 22, 23 are arranged in order from the first side surface 11 toward the second side surface 12 in the T direction. The first, second, and third internal electrodes 21, 22, 23 include ends, in the L direction, exposed from the first end surface 15 of the body 10, and electrically connected in contact with the first external electrode 41.

The fourth, fifth, and sixth internal electrodes 24, 25, 26 are arranged in order from the first side surface 11 toward the second side surface 12 in the T direction. The fourth, fifth, and sixth internal electrodes 24, 25, 26 have ends, in the L direction, exposed from the second end surface 16 of the body 10, and electrically connected in contact with the second external electrode 42.

The first internal electrode 21 and the fourth internal electrode 24 are located on the same level in the T direction, the second internal electrode 22 and the fifth internal electrode 25 are located on the same level in the T direction, and the third internal electrode 23 and the sixth internal electrode 26 are located on the same level in the T direction.

The first internal electrode 21, the fifth internal electrode 25, and the third internal electrode 23 are arranged in order from the first side surface 11 toward the second side surface in the T direction. The first, fifth, and third internal electrodes 21, 25, and 23 include the other ends, in the L direction, located adjacent to have an overlap in the T direction.

The first internal electrode 21 corresponds to the outermost internal electrode disposed outermost in the T direction. The fifth internal electrode 25 corresponds to an adjacent internal electrode overlapping the outermost internal electrode in the T direction.

In a cross section including the L direction and T direction of the body 10, a first distance that is the shortest distance between the first internal electrode 21 (outermost internal electrode) and the second external electrode 42 is denoted by d, whereas a second distance that is the shortest distance between the first internal electrode 21 (outermost internal electrode) and the fifth internal electrode 25 (adjacent internal electrode) is denoted by ed. In this case, the distances satisfy $4 \leq (d/ed)$, preferably satisfy $5 \leq (d/ed)$, and further preferably satisfy $6 \leq (d/ed)$, for example. In addition, the distances satisfy $(d/ed) \leq 10$, for example.

Concretely speaking, the first distance d refers to the distance between the other end (the left end in FIG. 3) of the first internal electrode 21 in the L direction and the end surface (the right end surface in FIG. 3) of the first surface section 141 of the second external electrode 42 in the L direction. The second distance ed refers to the distance between the first internal electrode 21 and the fifth internal electrode 25 in the T direction.

It is to be noted that the distance between the other end of the third internal electrode 23 in the L direction and the end surface of the second surface section 142 of the second external electrode 42 in the L direction is equal or substantially equal to the first distance d. The distance between the fifth internal electrode 25 and the third internal electrode 23 is equal or substantially equal to the second distance ed.

The minimum thickness of the body 10 is denoted by Tm between the surface of the body 10 and the internal electrode located closest to the surface, among the multiple internal electrodes 21 to 26, in the T direction. The minimum thickness of the body 10 is denoted by Wm between the surface of the body 10 and the internal electrode located closest to the surface, among the multiple internal electrodes 21 to 26, in the W direction. In this case, the minimum thicknesses satisfy $(Tm/Wm) \leq 0.4$, for example.

Concretely speaking, as shown in FIG. 2, the minimum thickness Tm of the body 10 refers to the distance between the first side surface 11 of the body 10 and the first internal electrode 21. The minimum thickness Wm of the body 10 refers to the distance between the third side surface 13 of the body 10 and the fifth internal electrode 25.

It is to be noted that the distance between the first side surface 11 of the body 10 and the fourth internal electrode 24, the distance between the second side surface 12 of the body 10 and the third internal electrode 23, and the distance between the second side surface 12 of the body 10 and the sixth internal electrode 26 are equal or substantially equal to the minimum thickness Tm. The distances between the third side surface 13 of the body 10 and the first to fourth and sixth internal electrodes 21 to 24 and 26, and the distances between the fourth side surface 14 of the body 10 and the first to sixth internal electrodes 21 to 26 are equal or substantially equal to the minimum thickness Wm.

The size of the thermistor element 1 preferably has, for example, the JIS 0603 size. The JIS 0603 size is approximately (0.6±0.03) mm (L direction)×(0.3±0.03) mm (W direction), for example. It is to be noted that the size of the thermistor element 1 may be other sizes such as the JIS 1005 size and the JIS 1608 size.

Next, a non-limiting example of a method for manufacturing the thermistor element 1 will be described.

First, materials for a ceramic are subjected to mixing and grinding, thus preparing a mixed power, and the mixed powder is subjected to calcination treatment, thus preparing a calcined powder. Thereafter, the calcined powder is formed into the shape of a sheet, thus preparing sheet bodies, a material for the internal electrodes 21 to 26 is applied by printing to the sheet bodies, and the sheet bodies and the internal electrodes 21 to 26 are stacked alternately to prepare a stacked body. Thereafter, the stacked body is subjected to firing, thus preparing the body with the internal electrodes 21 to 26 provided therein. Thereafter, a material for the electrode layers of the first and second external electrodes 41, 42 is applied to the surface of the body 10, and baked, thus preparing the electrode layers. Thereafter, the plated layers are laminated on the electrode layers by plating, thus preparing the first and second external electrodes 41, 42. Thus, the thermistor element 1 is prepared. The lengths of the internal electrodes 21 to 26 along the L direction are determined by the lengths obtained by applying the material for the internal electrodes 21 to 26.

The thermistor element 1 described above satisfies 4≤(d/ed), for example, thus making it possible to make the distance between the first internal electrode (outermost internal electrode) 21 and the second external electrode 42 equal to or more than a certain value (4ed), and thus increase the resistance between the first internal electrode 21 and the second external electrode 42 to reduce the contribution ratio of the resistance between the first internal electrode 21 and the second external electrode 42 to the resistance of the whole product. Therefore, even when the dimension of the second external electrode 42 in the L direction varies from one product to another, the resistance is prevented from varying from one product to another.

In contrast, when the ratio (d/ed) is lower than 4, the first internal electrode 21 is closer to the second external electrode 42, thus reducing the resistance between the first internal electrode 21 and the second external electrode 42, and thus increasing the contribution ratio of the resistance between the first internal electrode 21 and the second external electrode 42 to the resistance of the whole product. For this reason, when the dimension of the second external electrode 42 in the L direction varies from one product to another, the resistance varies significantly from one product to another.

In short, the inventors of the present application have discovered that an overlap region in the T direction between the two internal electrodes connected to the different external electrodes makes a significant contribution to the whole resistance. Further, the inventors of the present application have focused attention on, as factors responsible for the resistance, the second distance ed between the two internal electrodes that have an overlap with each other, and the first distance d between the two internal electrodes that have the overlap with each other and the external electrode. Further, the inventors of the present application have focused attention on the ratio between the distances, thus achieving the effect of preventing the resistance from varying from one product to another.

In addition, the thermistor element 1 described above satisfies (d/ed)≤10, for example, thus making it possible to make the distance between the first internal electrode (outermost internal electrode) 21 and the second external electrode 42 equal to or less than a certain value (10ed), and ensure the size of an overlap area between the first internal electrode 21 and the fifth internal electrode 25 adjacent to the first internal electrode 21. Therefore, the resistance between the first internal electrode 21 and the fifth internal electrode 25 is able to be kept low, and the resistance of the whole product is able to be kept low.

In contrast, when the ratio (d/ed) is higher than 10, the first internal electrode 21 is spaced from the second external electrode 42, thus reducing the size of an overlap area between the first internal electrode 21 and the fifth internal electrode 25. Therefore, the resistance between the first internal electrode 21 and the fifth internal electrode 25 fails to be kept low, thus making it difficult to keep the resistance of the whole product low. It is to be noted that it is conceivable that the size of an overlap area between the first internal electrode 21 and the fifth internal electrode 25 is ensured by locating the fifth internal electrode 25 close to the first external electrode 41 while spacing the first internal electrode 21 from the second external electrode 42. However, it is not realistic for actual manufacturing, because the second internal electrode 22 is made excessively short by extending the fifth internal electrode 25.

In addition, because the thermistor element 1 mentioned above preferably satisfies (Tm/Wm)≤0.4, for example, the thickness Tm of the body 10 between the surface 11 of the body 10 and the first internal electrode 21 will be reduced in the T direction to make the first internal electrode 21 close to the second external electrode 42. According to a preferred embodiment of the present invention, the distance between the first internal electrode 21 and the second external electrode 42 can be made equal to or more than a certain value, because 4≤(d/ed) is satisfied. For example, in the small-size and low-profile thermistor element 1, there is a need to increase the number of internal electrodes to lower the resistance, thus reducing the distance between the surface 11 of the body 10 and the first internal electrode 21, and (Tm/Wm)≤0.4 may be thus satisfied. Even in this case, the resistance is prevented from varying from one product to another.

In other words, conventionally, with the development of smaller-size and lower-profile thermistor elements, the increased overlap area between internal electrodes and the reduced distance between internal electrodes have been required. However, reducing the distance between internal electrodes has a high level of technical difficulty, and there is a need to increase the overlap area between the internal electrodes. Further, trying to gain the overlap area reduces the margin of the body around the internal electrodes, thus increasing the contribution of the resistance of the body between the internal electrodes and an external electrode which are different electrodes.

For this reason, the variation in initial resistance is affected significantly by dimensional variation of the external electrode, and the like. In addition, resistance reliability is lowered by aging degradation of the body surface which is likely to be affected by the external environment. Therefore, according to a preferred embodiment of the present invention, satisfying 4≤(d/ed) resolves the problem of variation in initial resistance and the problem with resistance reliability due to aging degradation.

In addition, in accordance with the thermistor element 1 mentioned above, the number of the first, second, and third internal electrodes 21, 22, 23 connected to the first external electrode 41 and the number of the fourth, fifth, and sixth internal electrodes 24, 25, 26 connected to the second external electrode 42 are each 3, which is an odd number. Thus, the first, second, and third internal electrodes 21, 22, 23 connected to the first external electrode 41 are likely to be structurally biased to the second external electrode 42 due to manufacturing reasons. More specifically, the first internal electrode 21 is likely to be structurally close to the second external electrode 42. According to a preferred embodiment of the present invention, because 4≤(d/ed) is satisfied, the distance between the first internal electrode 21 and the second external electrode 42 is able to be made equal to or more than a certain value, and the resistance is thus prevented from varying from one product to another.

Second Preferred Embodiment

Figure 4:
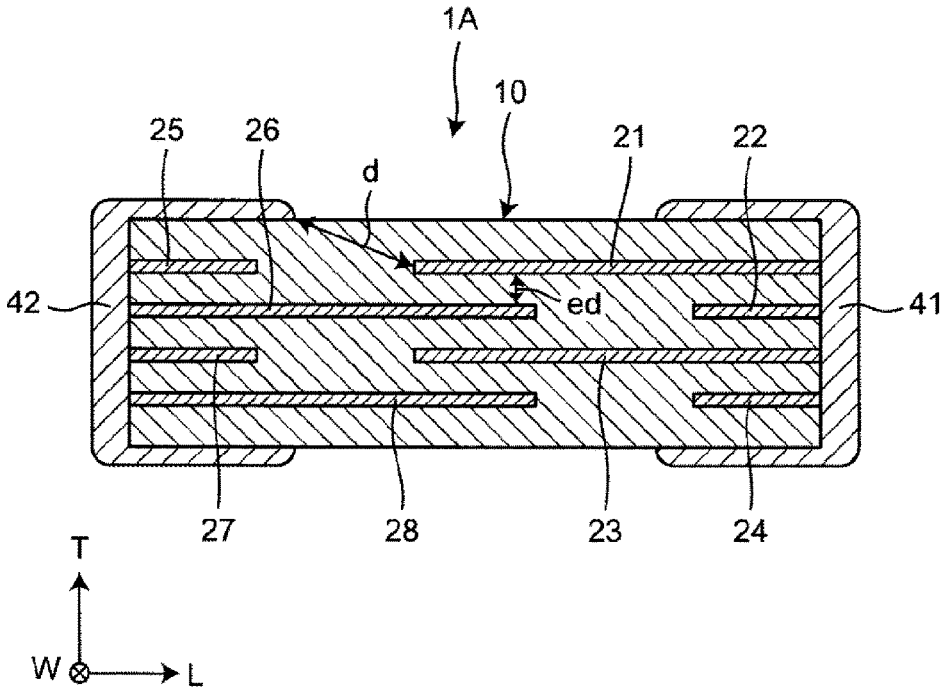
FIG. 4 is a cross-sectional view illustrating a thermistor element according to a second preferred embodiment of the present invention.

FIG. 4 is a cross-sectional view illustrating a thermistor element according to a second preferred embodiment of the present invention. The second preferred embodiment differs from the first preferred embodiment only in the number of internal electrodes. The configuration only associated with the difference will be described below. It is to be noted that in the second preferred embodiment, the same reference numerals as those in the first preferred embodiment refer to the same configuration as that in the first preferred embodiment, and the explanation of the configuration will be thus left out.

As shown in FIG. 4, in a thermistor element 1A according to the second preferred embodiment, the number of first to fourth internal electrodes 21 to 24 connected to a first external electrode 41 and the number of fifth to eighth internal electrodes 25 to 28 connected to a second external electrode 42 are each 4, which is an even number.

The first to fourth internal electrodes 21 to 24 are arranged in order from the top downward in the T direction. The fifth to eighth internal electrodes 25 to 28 are arranged in order from the top downward in the T direction.

The first, sixth, third, and eighth internal electrodes 21, 26, 23, and 28 have the other ends, in the L direction, located adjacent to have an overlap in the T direction. The first internal electrode 21 corresponds to the outermost internal electrode disposed outermost in the T direction. The sixth internal electrode 26 corresponds to an adjacent internal electrode overlapping the outermost internal electrode in the T direction.

A first distance d refers to the distance between the other end (the left end in FIG. 4) of the first internal electrode 21 in the L direction and an end surface (a right end surface in FIG. 4) of a first surface section 141 of the second external electrode 42 in the L direction. A second distance ed refers to the distance between the first internal electrode 21 and the sixth internal electrode 26 in the T direction. In this case, the distances satisfy 4≤(d/ed), and satisfy (d/ed)≤10.

The thermistor element 1A described above satisfies 4≤(d/ed), for example, and thus, as explained in the first preferred embodiment mentioned above, even when the dimension of the second external electrode 42 in the L direction varies from one product to another, the resistance is prevented from varying from one product to another. In addition, the element satisfies (d/ed)≤10, for example, and thus, as explained in the first preferred embodiment mentioned above, the resistance between the first internal electrode 21 and the sixth internal electrode 26 is able to be kept low, and the resistance of the whole product is able to be kept low.

In addition, in accordance with the thermistor element 1A described above, the number of the first to fourth internal electrodes 21 to 24 connected to the first external electrode 41 and the number of the fifth to eighth internal electrodes 25 to 28 connected to the second external electrode 42 are even numbers, thus making the first to fourth internal electrodes 21 to 24 connected to the first external electrode 41 unlikely to be structurally biased to the second external electrode 42 due to manufacturing reasons. More specifically, the first internal electrode 21 is unlikely to be structurally close to the second external electrode 42. Therefore, the distance between the first internal electrode 21 and the second external electrode 42 is easily made equal to or more than a certain value, thus making it possible to prevent the resistance from varying from one product from another.

It is to be noted that the present invention is not limited to the preferred embodiments described above, but the design is able to be changed without departing from the spirit of the present invention.

While the peripheral surfaces of the bodies preferably have rectangular or substantially rectangular cross sections in the preferred embodiments, the sections may be triangle, or pentagonal or more, or may be circular, elliptical, or oval.

The condition of (d/ed)≤10 preferably is satisfied in the preferred embodiments described above, but the ratio (d/ed) may be larger than 10, for example. The condition of (Tm/Wm)≤0.4 preferably is satisfied in the preferred embodiments described above, but the ratio (Tm/Wm) may be larger than 0.4, for example.

EXAMPLES

Example 1

Next, Table 1 shows values calculated in accordance with a simulation according to Example 1 for the thermistor element 1 according to the first preferred embodiment of the present invention.

TABLE 1

| Shift [μm] | Tm/Wm | d/ed | Rate of Change in Resistance [%] (E dimension: −20%) | Rate of Change in Resistance [%] (E dimension: +20%) |
|---|---|---|---|---|
| −30 | 0.326 | 8.36 | 0.16 | −0.26 |
| −15 | 0.326 | 6.91 | 0.16 | −0.29 |
| 0 | 0.326 | 5.49 | 0.19 | −0.68 |
| 20 | 0.326 | 3.70 | 0.58 | −1.91 |
| 30 | 0.326 | 2.91 | 1.03 | −3.48 |

Table 1 shows the rate of change (variation) in the resistance of the thermistor element 1 in the case of varying the ratio (d/ed) and varying (variation) the dimension of the second external electrode along the L direction (referred to as an E dimension). The ratio (Tm/Wm) is about 0.326, which satisfies the condition of being about 0.4 or less, for example. The number of internal electrodes connected to each of the first and second external electrodes is 3, for example.

Figure 5A:
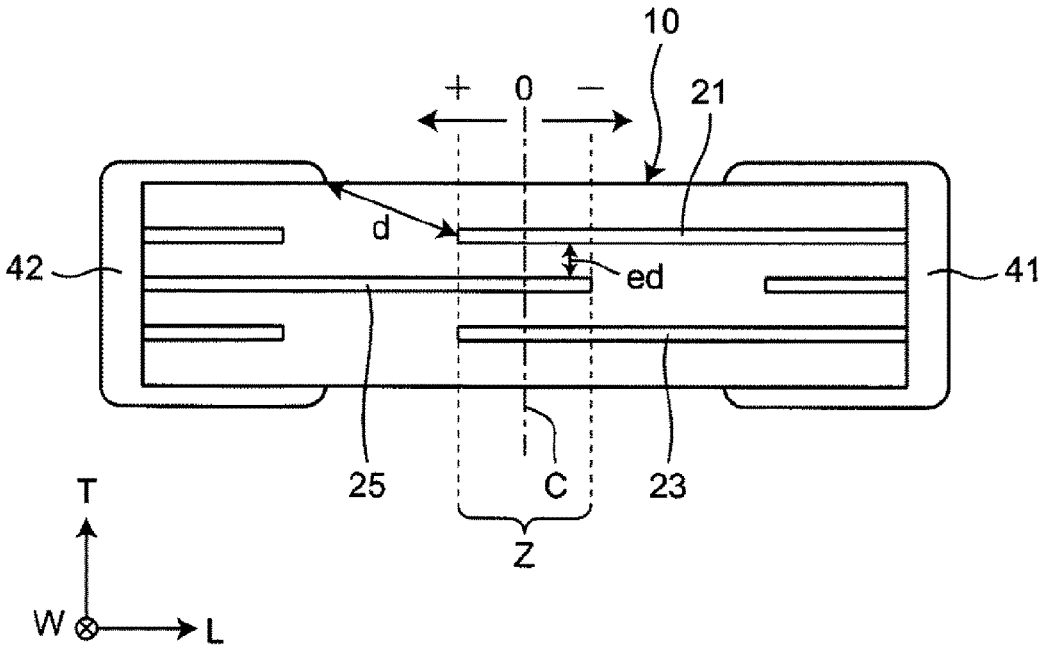
FIG. 5A is an explanatory diagram for explaining a shift in a thermistor element.

The shift listed in Table 1 will be described. As shown in FIG. 5A, the shift refers to the amount of L-direction displacement of a center C in the L direction in an overlap region Z of first, third, and fifth internal electrodes 21, 23, 25 in an LT cross section. The position of the center C in the case of the ratio (d/ed) of about 5.49 is regarded as a shift 0. The positive shift means that the center C is shifted from the shift 0 toward the second external electrode 42. The negative shift means that the center C is shifted from the shift 0 toward the first external electrode 41. In short, as the shift is larger, the center C is closer to the second external electrode 42, the first internal electrode 21 is closer to the second external electrode 42, and the ratio (d/ed) is decreased.

Concretely speaking, the ratio (d/ed) is about 8.36 when the shift is about −30 μm, the ratio (d/ed) is about 6.91 when the shift is about −15 μm, the ratio (d/ed) is about 3.70 when the shift is about 20 μm, and the ratio (d/ed) is about 2.91 when the shift is about 30 μm.

Figure 5B:
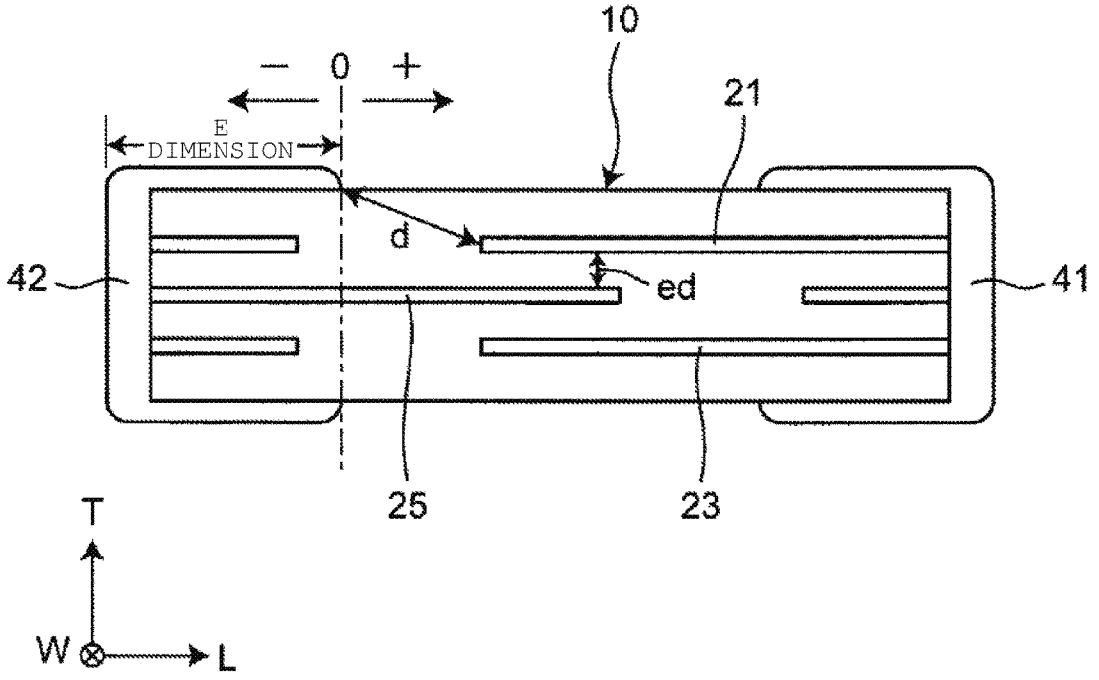
FIG. 5B is an explanatory diagram for explaining the rate of change depending on the E dimension of an external electrode of a thermistor element.

The rate of change in resistance with changes in E dimension, listed in Table 1, will be described. As shown in FIG. 5B, the E dimension of the second external electrode 42 obtained when the ratio (d/ed) has the value listed in Table 1 is regarded as a reference value 0%. The E dimension of about −20% means that the E dimension in the case of the reference value 0% is decreased by 20%. The E dimension +20% means that the E dimension in the case of the reference value 0% is increased by 20%. Further, the rate of change in resistance with the E dimension of about −20% indicates the rate of change from the resistance with the E dimension 0%. Thus, when the E dimension is decreased, d is increased, and the resistance of the thermistor element 1 is increased. The rate of change in resistance E dimension of about +20% indicates the rate of change from the resistance with the E dimension 0%. Thus, when the E dimension is increased, d is decreased, and the resistance of the thermistor element 1 is decreased.

Concretely speaking, when the ratio (d/ed) is about 8.36, the rate of change in resistance with the E dimension of about −20% is about 0.16, whereas the rate of change in resistance E dimension of about +20% is about −0.26, for example. When the ratio (d/ed) is about 6.91, the rate of change in resistance with the E dimension of about −20% is about 0.16, whereas the rate of change in resistance E dimension of about +20% is about −0.29, for example. When the ratio (d/ed) is about 5.49, the rate of change in resistance with the E dimension of about −20% is about 0.19, whereas the rate of change in resistance E dimension of about +20% is about −0.68, for example. When the ratio (d/ed) is about 3.70, the rate of change in resistance with the E dimension of about −20% is about 0.58, whereas the rate of change in resistance E dimension of about +20% is about −1.91, for example. When the ratio (d/ed) is about 2.91, the rate of change in resistance with the E dimension of about −20% is about 1.03, whereas the rate of change in resistance E dimension of about +20% is about −3.48, for example.

As can be seen from Table 1, when 4≤(d/ed) is satisfied, the difference is small between the rate of change in resistance with the E dimension of about −20% and the rate of change in resistance E dimension of about +20%, and the resistance of the thermistor element 1 is able to be prevented from varying even when the E dimension of the second external electrode 42 varies.

Example 2

Next, Table 2 shows values calculated in accordance with a simulation according to Example 2 for the thermistor element 1 according to the first preferred embodiment of the present invention.

TABLE 2

| Shift [μm] | Tm/Wm | d/ed | Rate of Change in Resistance [%] (E dimension: −20%) | Rate of Change in Resistance [%] (E dimension: +20%) |
|---|---|---|---|---|
| −30 | 0.163 | 8.18 | 0.14 | −0.25 |
| −15 | 0.163 | 6.69 | 0.18 | −0.32 |
| 0 | 0.163 | 5.21 | 0.34 | −0.59 |
| 15 | 0.163 | 3.75 | 0.49 | −1.29 |
| 30 | 0.163 | 2.34 | 1.07 | −3.87 |

Table 2 varies from Table 1 in Example 1 in calculation attached with the varied conditions of ratios (Tm/Wm) and (d/ed). The shift and the rate of change in resistance are as described in Example 1. As can be seen from Table 2, when 4≤(d/ed) is satisfied, the difference is small between the rate of change in resistance with the E dimension of about −20% and the rate of change in resistance E dimension of about +20%, and the resistance of the thermistor element 1 can be prevented from varying even when the E dimension of the second external electrode 42 varies.

Example 3

Next, Table 3 shows values calculated in accordance with a simulation according to Example 3 for the thermistor element 1 according to the first preferred embodiment of the present invention.

TABLE 3

| Shift [μm] | Tm/Wm | d/ed | Rate of Change in Resistance [%] (E dimension: −20%) | Rate of Change in Resistance [%] (E dimension: +20%) |
|---|---|---|---|---|
| −40 | 0.326 | 9.17 | 0.11 | −0.48 |
| −20 | 0.326 | 7.18 | 0.25 | −0.58 |
| 0 | 0.326 | 5.21 | 0.29 | −0.59 |
| 20 | 0.326 | 3.27 | 0.39 | −1.17 |
| 40 | 0.326 | 1.50 | 0.98 | −2.64 |

Table 3 varies from Table 1 in Example 1 in calculation attached with the varied conditions of ratio (d/ed). The measurement of the shift differs from that according to Example 1. It is to be noted that the rate of change in resistance is as described in Example 1.

Figure 5C:
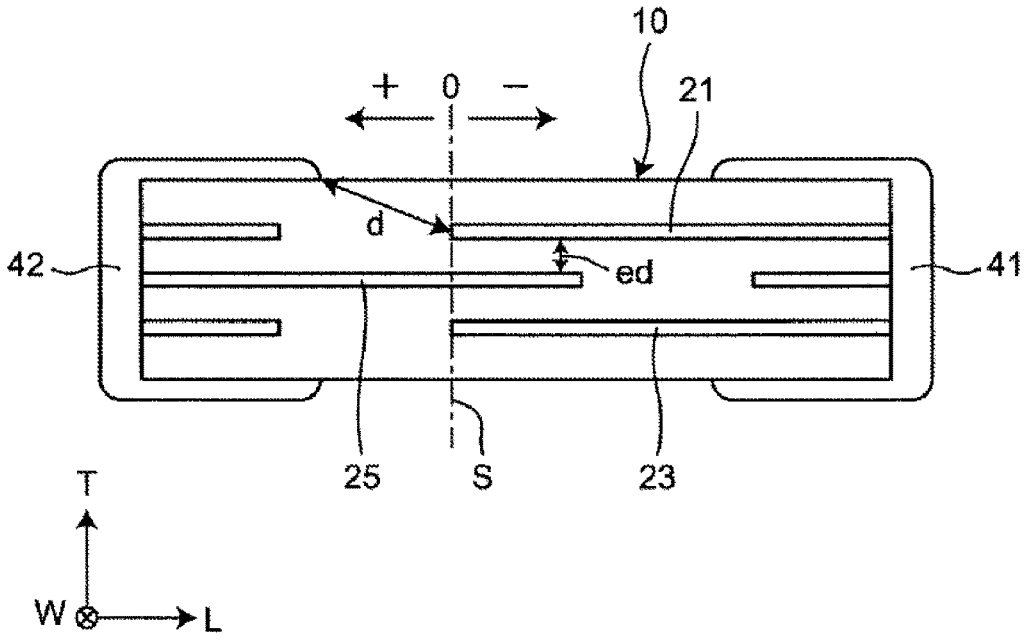
FIG. 5C is an explanatory diagram for explaining a shift in a thermistor element.

As shown in FIG. 5C, the shift refers to the amount of L-direction displacement of a reference line S that coincides with the end surface of the first internal electrode 21 in an LT cross section. The shift is regarded as 0 when the reference line S has an overlap with the end surface of the third internal electrode 23, with the ratio (d/ed) of about 5.21, for example. The positive shift means that the reference line S (the end surface of the first internal electrode 21) is shifted from the shift 0 toward the second external electrode 42. The negative shift means that the reference line S (the end surface of the first internal electrode 21) is shifted from the shift 0 toward the first external electrode 41. In short, as the shift is larger, the reference line S is closer to the second external electrode 42, the first internal electrode 21 is closer to the second external electrode 42, and the ratio (d/ed) is decreased.

As can be seen from Table 3, when 4≤(d/ed) is satisfied, the difference is small between the rate of change in resistance with the E dimension of about −20% and the rate of change in resistance E dimension of about +20%, and the resistance of the thermistor element 1 is able to be prevented from varying even when the E dimension of the second external electrode 42 varies.

Example 4

Next, Table 4 shows actual measurement values according to Example 4 for the thermistor element 1 according to the first preferred embodiment of the present invention.

TABLE 4

| Shift [μm] | Tm/Wm | d/ed | Variation in Resistance Value (3CV) |
|---|---|---|---|
| −33.1 | 0.326 | 8.66 | 3.78 |
| −16.6 | 0.326 | 7.06 | 3.78 |
| 0.0 | 0.326 | 5.49 | 3.30 |
| 16.6 | 0.326 | 3.92 | 5.71 |
| 33.1 | 0.326 | 2.69 | 7.46 |

Table 4 shows the variation in the resistance value of the thermistor element 1 in the case of varying the ratio (d/ed). The ratio (Tm/Wm) is about 0.326, which satisfies the condition of being about 0.4 or less, for example. The number of internal electrodes connected to each of the first and second external electrodes is 3.

The shift listed in Table 4 is as described in Example 1. The 3CV listed in Table 4 is obtained by triplicating the variation coefficient (Coefficient of variation) regarding the resistance value. The variation coefficient, which is obtained by dividing the standard deviation by the arithmetic mean, indicates relative variation.

As can be seen from Table 4, when 4≤(d/ed) is satisfied, the variation in resistance value is small, and the resistance of the thermistor element 1 is able to be prevented from varying even when the E dimension of the second external electrode 42 varies.

Example 5

Next, Table 5 shows values calculated in accordance with a simulation according to Example 5 for the thermistor element 1A according to the second preferred embodiment of the present invention.

TABLE 5

| Shift [μm] | Tm/Wm | d/ed | Rate of Change in Resistance [%] (E dimension: −20%) | Rate of Change in Resistance [%] (E dimension: +20%) |
|---|---|---|---|---|
| −30 | 0.163 | 9.74 | 0.21 | −0.67 |
| −15 | 0.163 | 8.25 | 0.15 | −0.23 |
| 0 | 0.163 | 6.76 | 0.09 | −0.25 |
| 20 | 0.163 | 4.60 | 0.21 | −0.17 |
| 40 | 0.163 | 2.68 | 0.31 | −1.31 |
| 60 | 0.163 | 1.21 | 1.42 | −6.06 |

Table 5 varies from Table 1 in Example 1 in calculation attached with the varied conditions of ratios (Tm/Wm) and (d/ed). The shift and the rate of change in resistance are as described in Example 1. The number of internal electrodes connected to each of the first and second external electrodes is 4. As can be seen from Table 5, when 4≤(d/ed) is satisfied, the difference is small between the rate of change in resistance with the E dimension of about −20% and the rate of change in resistance E dimension of about +20%, and the resistance of the thermistor element 1A is able to be prevented from varying even when the E dimension of the second external electrode 42 varies.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A thermistor element comprising:

a body including a length direction, a width direction, and a height direction;

two external electrodes covering both ends of the body in the length direction; and multiple internal electrodes laminated at intervals in a height direction in the body; wherein the multiple internal electrodes include:

an outermost internal electrode disposed outermost in the height direction and connected to one of the external electrodes; and an adjacent internal electrode overlapping with the outermost internal electrode in the height direction and connected to the other external electrode;

the outermost internal electrode extends past a center or a substantial center of the body; and in a cross section including the length direction and height direction of the body, a first distance that is a shortest distance between the outermost internal electrode and the other external electrode is denoted by d, and a second distance that is a shortest distance between the outermost internal electrode and the adjacent internal electrode is denoted by ed, the first and second distances satisfy 4≤(d/ed)≤10.

2. The thermistor element according to claim 1, wherein when a minimum thickness of the body is denoted by Tm between a surface of the body and an internal electrode located closest to the surface, among the multiple internal electrodes, in the height direction; and when a minimum thickness of the body is denoted by Wm between a surface of the body and an internal electrode located closest to the surface, among the multiple internal electrodes, in the width direction;

the minimum thicknesses satisfy 0<(Tm/Wm)≤0.4.

3. The thermistor element according to claim 1, wherein a number of the internal electrodes connected to the one of the external electrodes and a number of the internal electrodes connected to the other external electrode are odd numbers.

4. The thermistor element according to claim 1, wherein a number of the internal electrodes connected to the one of the external electrodes and a number of the internal electrodes connected to the other external electrode are even numbers.

5. The thermistor element according to claim 1, wherein the body includes multiple ceramic layers laminated together to define an integral structure.

6. The thermistor element according to claim 5, wherein the ceramic layers are composed of a ceramic that has negative resistance-temperature characteristics.

7. The thermistor element according to claim 6, wherein the ceramic contains a manganese oxide as a main constituent, and includes at least one of a nickel oxide, a cobalt oxide, alumina, an iron oxide, a titanium oxide, and a zirconium oxide.

8. The thermistor element according to claim 1, wherein the external electrodes each include an electrode layer covering the body, and a plated layer laminated on the electrode layer.

9. The thermistor element according to claim 8, wherein the electrode layer is made of Ag, and the plated layer is made of Sn or Cu.

10. The thermistor element according to claim 1, wherein the multiple internal electrodes include at least one element of Ag, Pd, and Cu.

11. The thermistor element according to claim 1, wherein the multiple internal electrodes include first, second, and third internal electrodes arranged in order in the height direction and connected to the one of the external electrodes, and fourth, fifth, and sixth internal electrodes arranged in order in the height direction and connect to the other external electrode; and the outermost internal electrode is the first internal electrode and the adjacent internal electrode is the fifth internal electrode.

12. The thermistor element according to claim 11, wherein the first internal electrode and the fourth internal electrode are located on a same level in the height direction, the second internal electrode and the fifth internal electrode are located on a same level in the height direction, and the third internal electrode and the sixth internal electrode are located on a same level in the height direction.

13. The thermistor element according to claim 1, wherein the first and second distances satisfy $5 \leq (d/ed) \leq 10$.

14. The thermistor element according to claim 1, wherein the first and second distances satisfy $6 \leq (d/ed) \leq 10$.

* * * * *